US009966677B2

(12) United States Patent
Tziviskos et al.

(10) Patent No.: US 9,966,677 B2
(45) Date of Patent: May 8, 2018

(54) LOW-PROFILE SSD CONNECTOR

(71) Applicant: Apple Inc., Cupertino, CA (US)

(72) Inventors: George Tziviskos, Cupertino, CA (US); Aaron N. Miletich, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days. days.

(21) Appl. No.: 15/224,397

(22) Filed: Jul. 29, 2016

(65) Prior Publication Data

US 2018/0034176 A1 Feb. 1, 2018

(51) Int. Cl.

| | |
|---|---|
| ***H01R 12/00*** | (2006.01) |
| ***H01K 1/00*** | (2006.01) |
| ***H01R 12/72*** | (2011.01) |
| ***H01R 13/26*** | (2006.01) |
| ***H01R 13/658*** | (2011.01) |

(52) U.S. Cl.
CPC ..... *H01R 12/72* (2013.01); *H01R 13/26* (2013.01); *H01R 13/658* (2013.01)

(58) Field of Classification Search
CPC .. H01R 12/724; H01R 23/7073; H01R 23/02; H01R 24/62; H01R 12/585; H01R 12/526
USPC ..... 439/79, 660, 82, 83
See application file for complete search history.

(56) References Cited

U.S. PATENT DOCUMENTS 8,277,232 B2 * 10/2012 Herring ..... H01R 4/028 439/79
8,425,257 B2 * 4/2013 Gao ..... H01R 12/721 439/108
8,684,752 B2 * 4/2014 Hsueh ..... H01R 12/721 439/79
8,690,589 B2 * 4/2014 Ngo ..... H01R 12/7052 439/630
9,722,653 B2 * 8/2017 Han ..... H04B 1/3816
2011/0053388 A1 * 3/2011 Zhu ..... H01R 27/00 439/62
2012/0220171 A1 * 8/2012 Shimada ..... H01R 12/774 439/660
2013/0005190 A1 * 1/2013 Blanchfield ..... H01R 12/721 439/630
2013/0034972 A1 * 2/2013 Szczesny ..... H01R 12/722 439/62
2013/0040501 A1 * 2/2013 Peng ..... H05K 1/0248 439/660
2013/0273754 A1 * 10/2013 Kimura ..... H01R 13/7039 439/62
2013/0288534 A1 * 10/2013 Degner ..... H01R 12/721 439/630

* cited by examiner

*Primary Examiner* — Abdullah Riyami
*Assistant Examiner* — Thang Nguyen
(74) *Attorney, Agent, or Firm* — Kilpatrick Townsend & Stockton, LLP

(57) ABSTRACT

Connectors that may be used to connect optional or daughter cards or modules to main logic boards or motherboards in electronic devices. These connectors may have a reduced effective height and may be able to support high data rates. Cards in these connectors may be secured in place in an electronic device to avoid being inadvertently dislodged. The connectors may accept a card such as a solid state drive, memory card, subscriber identification module, or other type of card. Examples may also provide cards to be inserted in the connectors and boards to support the connectors.

17 Claims, 13 Drawing Sheets

LOW-PROFILE SSD CONNECTOR

BACKGROUND

The number and types of electronic devices available to consumers have increased tremendously the past few years and this increase shows no signs of abating. Electronic devices, such as portable media players, storage devices, tablets, netbooks, laptops, desktops, all-in-one computers, wearable computing devices, cell, media, and smart phones, televisions, monitors, and other display devices, navigation systems, and other devices have become ubiquitous.

Moreover, options for some particular devices have also proliferated. For example, for a particular device, the size of an internal memory may be an option. Other functionalities, such as video or graphics cards, network or cellular connections, and others, may also be made available as options or as possible upgrades. This may allow a manufacturer to offer products at several price points, and may allow customers to buy only the amount of functionality that is required to suit their needs and to possibly upgrade at a later time.

In these devices, various options may be added by including an optional or daughter card or module inside a housing of the electronic device. These optional or daughter cards or modules may be attached to a main logic board or motherboard. Specifically, these optional or daughter cards or modules may be attached to a board inside the electronic device housing using a connector.

Unfortunately, these connectors consume space inside the electronic device. This consumed space may increase the size of the electronic device or reduce the functionality that could otherwise be included in the electronic device. Also, data rates among devices in these electronic devices have increased tremendously. Using a connector may degrade signal quality and reduce the data rates to a lower frequency that may otherwise be achievable. Further, these optional or daughter cards or modules may inadvertently become dislodged when a force is applied to the electronic device.

Thus, what is needed are connectors that can be used to connect optional or daughter cards or modules to main logic board or motherboards in electronic devices. It may also be desirable for these connectors to have a reduced effective height and be able to support high data rates. It may also be desirable that they may be secured in place in an electronic device to avoid being inadvertently dislodged. The cards themselves and supporting boards are needed as well.

SUMMARY

Accordingly, embodiments of the present invention may provide connectors that may be used to connect optional or daughter cards or modules (referred to as cards herein) to main logic boards or motherboards (referred to as main logic boards herein) in electronic devices. These connectors may have a reduced effective height and may be able to support high data rates. Cards in these connectors may be secured in place in an electronic device to avoid being inadvertently dislodged. Embodiments of the present invention may also provide the cards and supporting boards, or some combination of boards, cards, and connectors.

An illustrative embodiment of the present invention may provide a connector having a reduced effective height by positioning at least a portion of the connector in an opening or over an edge a board that the connector is mounted on. This positioning may reduce an effective height of a connector from the combined height of the connector and board to the height of the connector alone. In a specific embodiment of the present invention, a connector may have a rear portion having connecting portions for contacts, where the connecting portions are fixed or soldered to the board. The connector may have a front portion extending either beyond an edge of the board or into an opening in the board. A card may be inserted into an opening in a front of the connector. This may position the card such that a bottom surface of the card is at least approximately in a plane with a top surface of the board. In other embodiments of the present invention, this may position the card such that a top surface of the card is at least approximately in a plane with a top surface of the board.

In these and other embodiments of the present invention, the connector may include a housing having a front opening. A row of contacts may be located along a top of the front opening in the housing, along a bottom of the opening, or both. The top row of contacts may include pairs of first contacts terminating in first connecting portions and single second contacts terminating in second connecting portions positioned between or adjacent to each pair of first contacts. The first connecting portions may be surface-mount portions and the second connecting portions may be through-hole portions, though this arrangement may be reversed or other arrangements may be used. The pairs of first contacts may convey differential signals, while the intervening single second contacts may convey ground or an AC ground, such as a power supply. This may electrically isolate the differential signals on the pairs of first contacts from each other and from external noise and other electromagnetic interference. This isolation may improve signal quality and increase the data rates that may be conveyed using this connector.

In these and other embodiments of the present invention, the connector may include a top shield over the housing and having a front edge folded over and into the front opening to form a top row of ground contacts. The connector may further include a bottom shield under the housing and having a front edge folded over and into the front opening to form a bottom row of ground contacts. The bottom shield may contact the top shield via a first tab at a first end of the bottom shield, a second tab and a second end of the bottom shield, and a rear tab at a rear of the bottom shield. The top shield may include a plurality of tabs along a rear. These tabs may be inserted into openings in the board. The front opening of the housing may further comprise a keying feature. The keying feature may prevent a user from inserting a card in a reversed or rotated manner in the connector.

In these and other embodiments of the present invention, a card may be inserted in a front opening of the connector. The card may include ground pads and a plurality of contacts on a top surface of the card and between a first edge of the card and the ground pads, where the first edge is inserted into the opening in the connector. The ground pads may form electrical connections with the top and bottom rows of ground pads formed by the top and bottom shields of the connector. Contacts on a top surface of the card may form electrical connections for signals and power with the top row of contacts of the connector.

The card may further comprise a second edge opposite the first edge. The second edge may have a first extended portion on a first end and a second extended portion on a second end. The first extended portion may a first opening and the second extended portion may have a second opening. A first fastener may be placed through the first opening in the card and a corresponding opening in the board and a second fastener may be placed through the second opening in the card and a corresponding opening in the board in order to secure the card in place. The card may further comprise a plurality of memory or other electronic devices on the top surface of the card, the bottom surface of the card, or both.

In various embodiments of the present invention, the components of the connectors may be formed in various ways of various materials. For example, contacts, shields, and other conductive portions of the connectors may be formed by stamping, metal-injection molding, machining, micro-machining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions, such as housing and other portions, may be formed using injection or other molding, 3-D printing, machining, or other manufacturing process. The nonconductive portions may be formed of silicon or silicone, rubber, hard rubber, plastic, nylon, elastomers, liquid-crystal polymers (LCPs), ceramics, or other nonconductive material or combination of materials.

Embodiments of the present invention may provide connectors, boards, and cards that may be located in various types of devices, such as portable computing devices, tablet computers, desktop computers, laptops, all-in-one computers, wearable computing devices, cell phones, smart phones, media phones, storage devices, portable media players, navigation systems, monitors, power supplies, adapters, remote control devices, chargers, and other devices. These connectors may provide pathways for signals and power for cards or other modules, such as solid state drives (SSDs), memory cards, subscriber identification modules (SIMs), Secure Digital cards, Secure Digital High Capacity cards, Secure Digital Extended Capacity cards, Secure Digital Ultra-High-Capacity I cards, Secure Digital Ultra-High-Capacity II cards, memory sticks, compact flash cards, communication modules, and other devices and modules that have been developed, are being developed, or will be developed in the future. These connectors may provide pathways for signals that are compliant with various standards such as Universal Serial Bus (USB), High-Definition Multimedia Interface® (HDMI), Digital Visual Interface (DVI), Ethernet, DisplayPort, Thunderbolt™, Lightning™, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. Embodiments of the present invention may provide these cards, supporting boards, and combinations of these cards, boards, and connectors.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
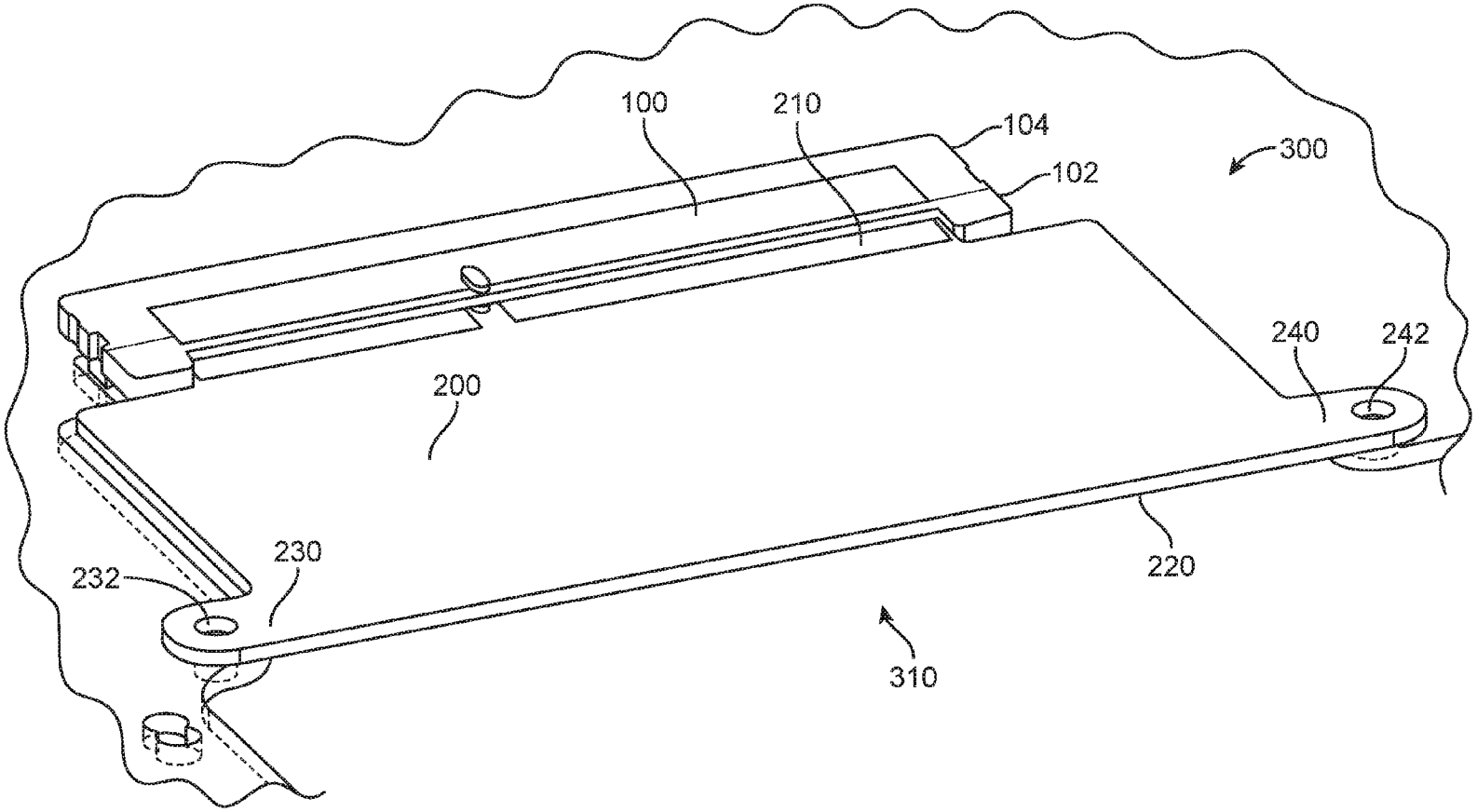
FIG. 1 illustrates a portion of an electronic system according to an embodiment of the present invention.

FIG. 1 illustrates a portion of an electronic system according to an embodiment of the present invention. This figure, as with the other included figures, is shown for illustrative purposes and does not limit either the possible embodiments of the present invention or the claims.

This figure includes a connector 100, card 200, and board 300. Connector 100 may include a front portion 102 for accepting a first edge 210 of card 200, and a rear portion 104 for mounting on board 300. Front portion 102 of connector 100 may be located in an opening 310 in board 300, or it may be located beyond an edge (not shown) of board 300. This may allow connector 100 to have a low profile, thereby saving space inside an electronic device.

Conventionally, an effective height of a connector may be a combined height of the connector and the board on which it resides. By arranging a connector in this manner, the effective height of the connector may be reduced to be approximately the height of the connector itself. In this particular example, card 200 may be positioned such that a bottom surface of card 200 is approximately in a plane with a top surface of board 300. This may be particularly useful when fastening card 200 to board 300, as shown here. In other embodiments of the present invention, card 200 may be positioned such that a top surface of card 200 is approximately in a plane with a top surface of board 300, though other arrangements are possible.

Traditionally, cards inserted into connectors may be jostled or inadvertently disconnected by forces applied to the electronic device that houses the card and connector. Accordingly, card 200 may be fixed in place relative to connector 100 and board 300 in order to prevent such dislocations. Specifically, a first edge 210 of card 200 may be inserted into connector 100. A second edge 220 of card 200 may include lateral extensions 230 and 240. Lateral extensions 230 and 240 may include openings 232 and 242. Openings 232 and 242 may align with corresponding openings (not shown) in board 300. Fasteners (not shown) may be inserted into openings 232, 242, and their corresponding openings in board 300, thereby fixing card 200 in place relative to connector 100 and board 300. This arrangement may fix both ends of the card 200 to board 300, thereby making an inadvertent disconnection between card 200 and connector 100 less likely. An example of a connector that may be used as connector 100 is shown in the following figure.

Figure 2:
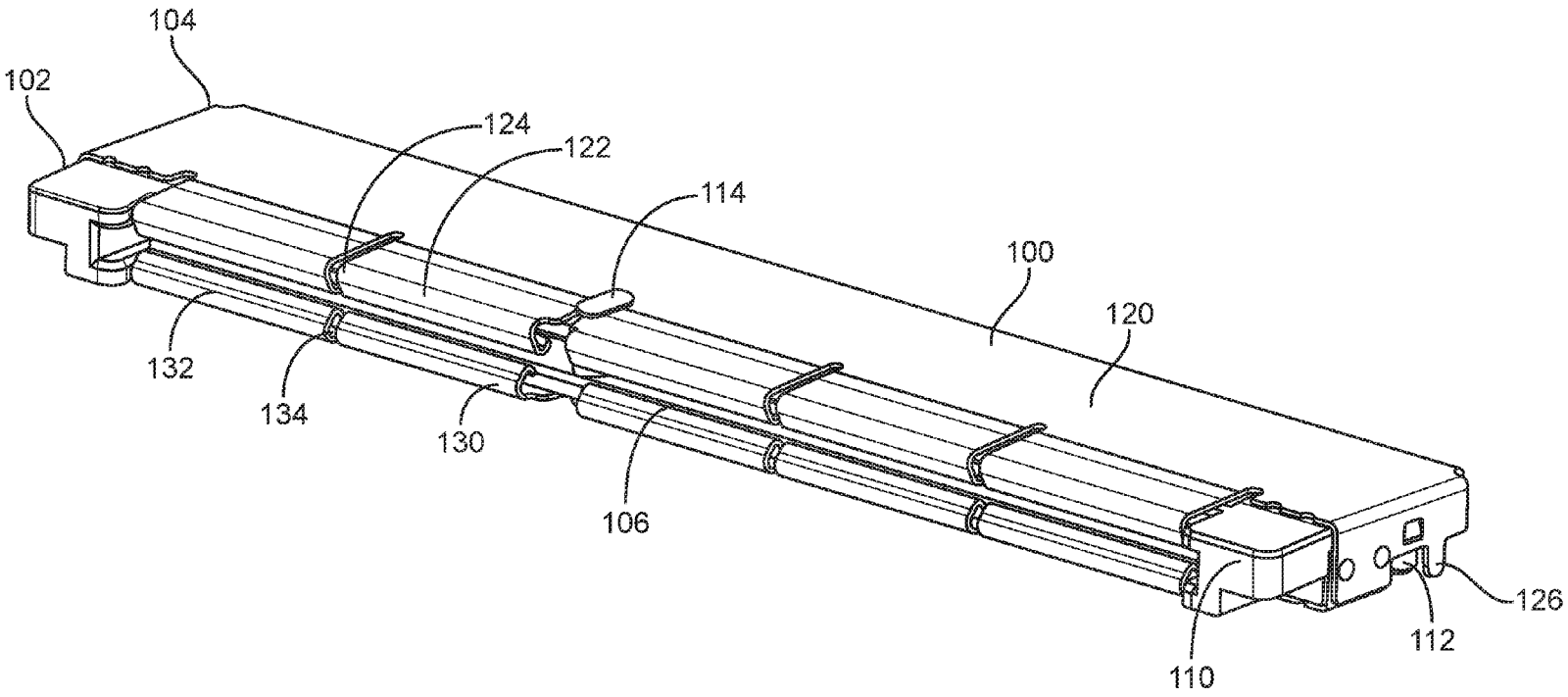
FIG. 2 illustrates a connector according to an embodiment of the present invention.

FIG. 2 illustrates a connector according to an embodiment of the present invention. Connector 100 may include an opening 106 for accepting a card 200 as shown in FIG. 1. Connector 100 may further include a front portion 102 and a rear portion 104. Connector 100 may include a housing 110, which may include posts 112 on rear portion 104. Post 112 may be inserted into corresponding holes in board 300, as shown in FIG. 1. Housing 110 may further include one or more keying features 114. Keying features 114 may prevent a reversed or rotated insertion of a card into connector 100. That is, keying features 114 may prevent a card that is incorrectly oriented by 180 degrees from being inserted into connector 100.

Connector 100 may include a top shield 120. Top shield 120 may be folded over into opening 106 to form ground contacts 122. Ground contacts 122 may form electrical connections with ground pads on a card (not shown) when the card is inserted into opening 106 in connector 100. Contacts 122 may form an improved connection with these ground pads when they are split by divisions 124 as shown. Connector 100 may further include bottom shield 130. Bottom shield 130 may include ground contacts 132 formed by bottom shield 130, which may be folded over back into opening 106. Ground contacts 132 may be separated by divisions 134 to improve an electrical connection to the ground pads on the card 200 (not shown). Further details of connector 100 are shown in the following figures.

Figure 3:
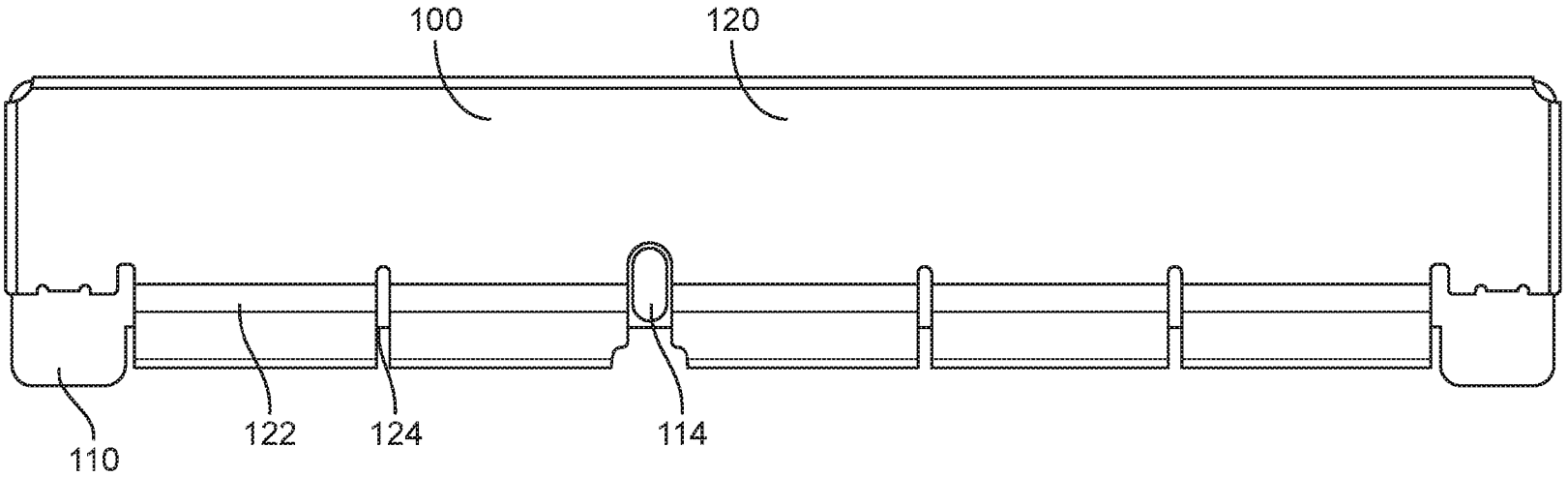
FIG. 3 illustrates a top view of a connector according to an embodiment of the present invention.

FIG. 3 illustrates a top view of a connector according to an embodiment of the present invention. Connector 100 may include top shield 120 over a top of housing 110. Housing 110 may include one or more keying features 114. Shield 120 may be folded to form ground contacts 122. Ground contacts 122 may be separated by divisions 124 to improve electrical connections with ground pads on a card (not shown) inserted into connector 100.

Figure 4:
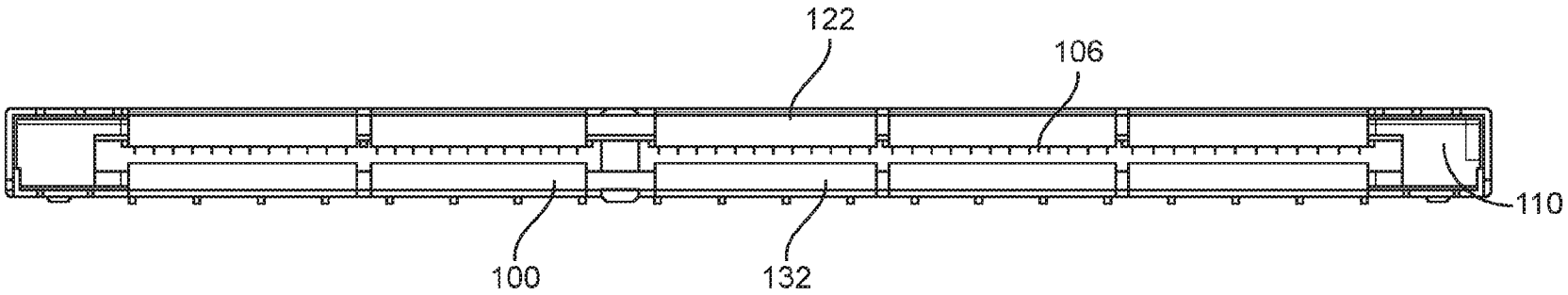
FIG. 4 illustrates a front view of a connector according to an embodiment of the present invention.

FIG. 4 illustrates a front view of a connector according to an embodiment of the present invention. Connector 100 may include housing 110. Housing 110 may include a front opening 106 of the connector. Ground contacts 122 and 132 may be located at the top and bottom of the opening 106 of connector 100.

Figure 5:
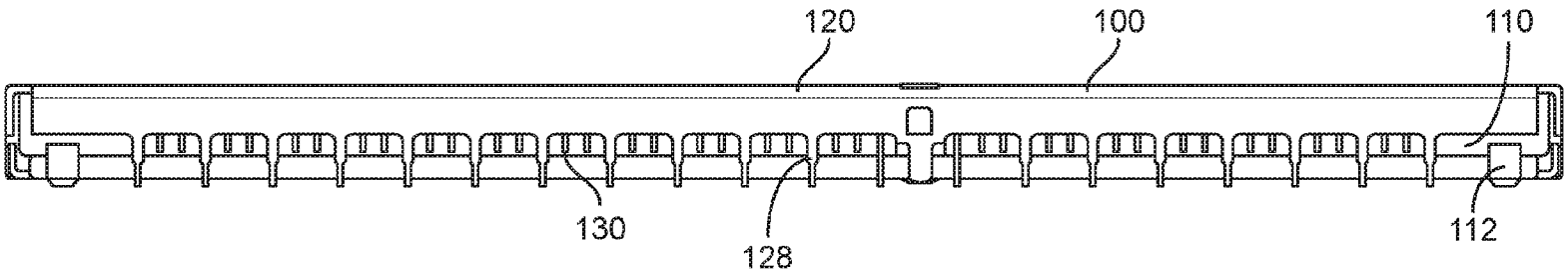
FIG. 5 illustrates a rear view of a connector according to an embodiment of the present invention.

FIG. 5 illustrates a rear view of a connector according to an embodiment of the present invention. Connector 100 may include housing 110, which may be shielded by a top shield 120 and a bottom shield 130. Top shield 120 may include a number of tabs 128. These tabs 128 may be inserted into openings in board 300 as shown in FIG. 1. Housing 110 may also include posts 112. Posts 112 may be inserted into openings in board 300 for mechanical stability and alignment.

Figure 6:
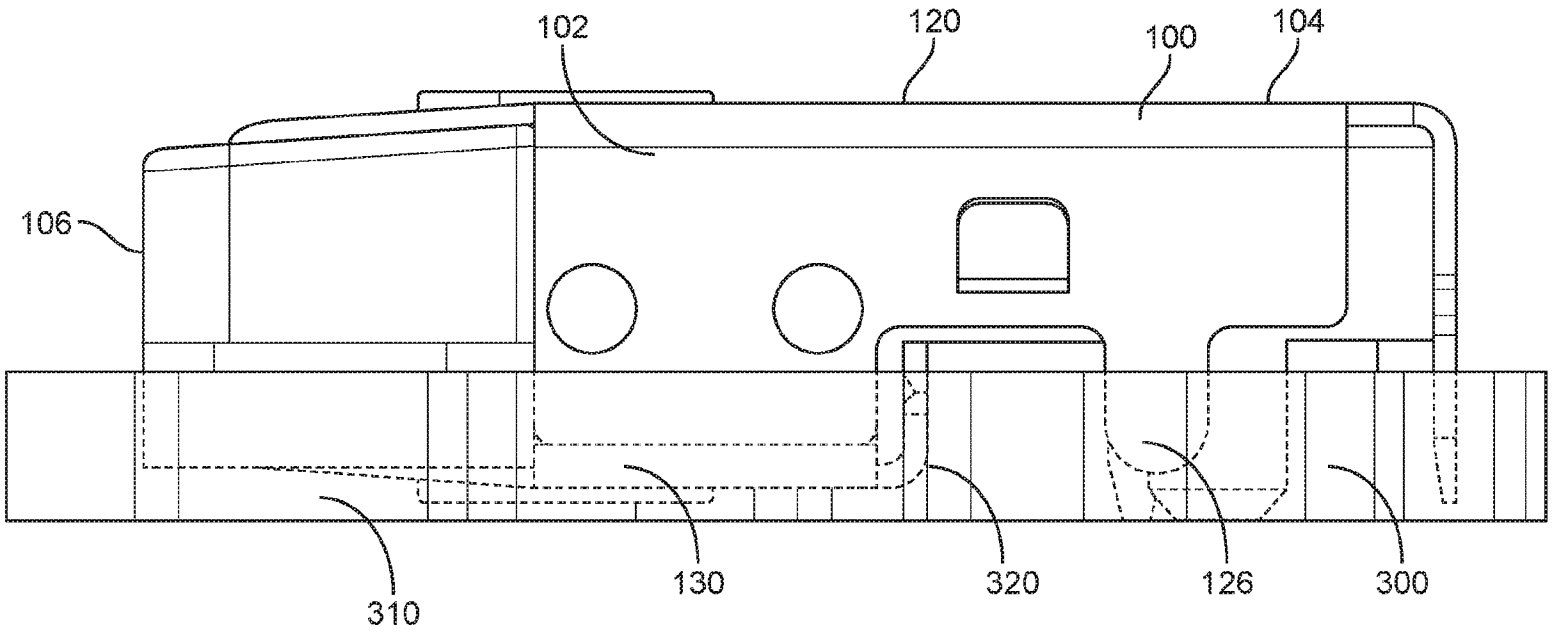
FIG. 6 illustrates a side view of a connector attached to a board according to embodiments of the present invention.

FIG. 6 illustrates a side view of a connector and a board according to embodiments of the present invention. Connector 100 may include opening 106 to accept a card 200 (not shown). Front portion 102 of connector 100 may be located beyond edge 320 of board 300. Specifically, board 300 may include an edge 320, which may define an end of board 300, or edge 320 may be an edge of an opening 310 in board 300. Rear portion 104 of connector 100 may be mounted on board 300. Rear portion 104 of connector 100 may include tabs 126 and other structures shown below which may be inserted into openings in board 300 or attached to contacts on a surface of the board 300. Examples are shown in the following figure.

Figure 7:
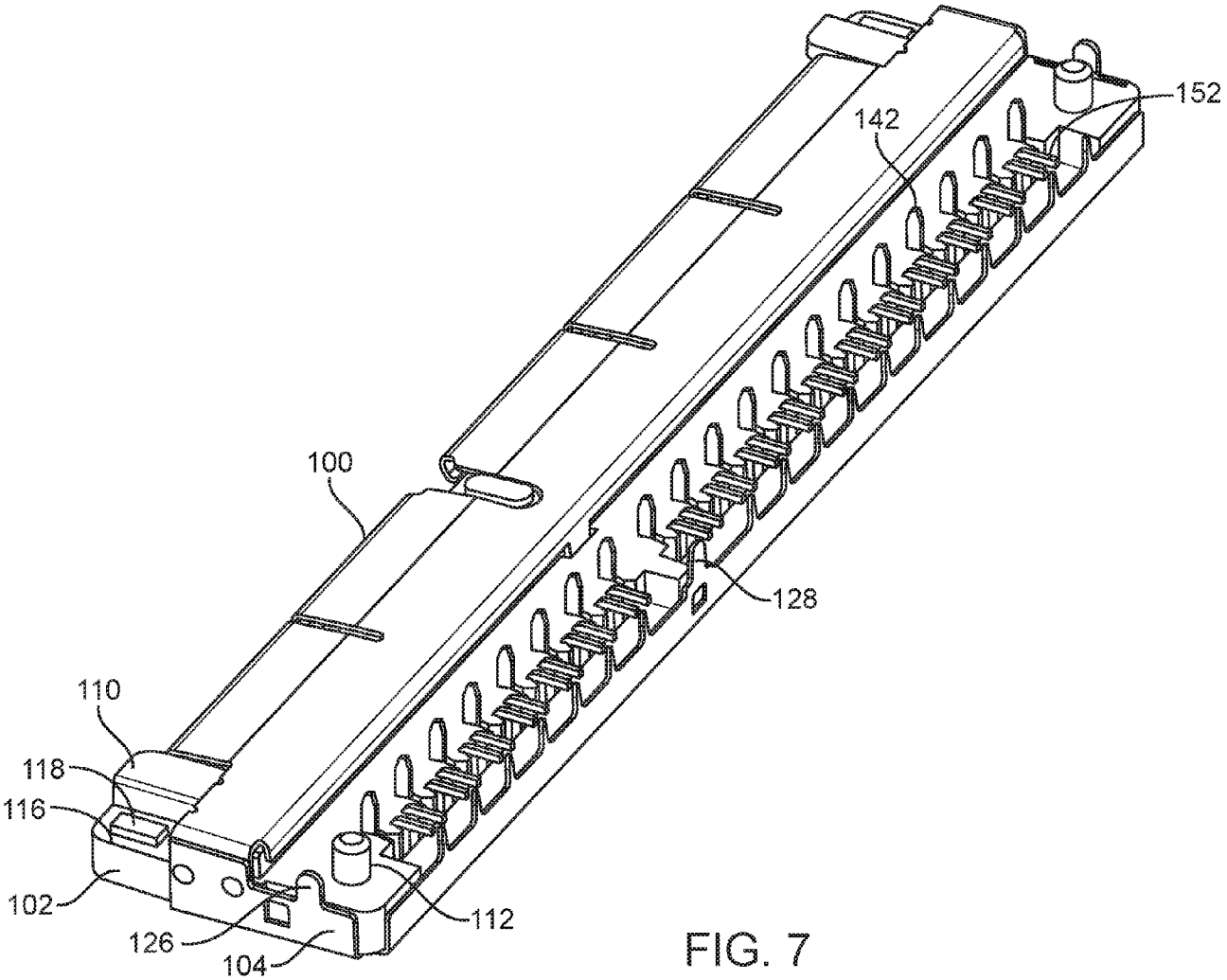
FIG. 7 illustrates a bottom side view of a connector according to an embodiment of the present invention.

FIG. 7 illustrates a bottom side view of a connector according to an embodiment of the present invention. Connector 100 may include a front portion 102 for accepting a card 200 (not shown) and a rear portion 104 for attaching to a board 300 (not shown). Front portion 120 may include narrow portions 116, each having a raised portion 118. Narrow portions 116 may be located over tabs or extensions on board 300 to provide mechanical support for connector 100, as shown below in FIG. 11.

Rear portion 104 may include posts 112, as well as tabs 126 and 128, to be inserted into openings in board 300. Rear portion 104 may also include first connecting portions, shown here as through-hole portions 142, and second connecting portions, shown here as surface-mount portions 152, of contacts of connector 100. These contacts are shown in more detail in the following figures.

Again, it may be desirable for connector 100 to support high frequency data rates. Accordingly, surface-mount portions 152 may be used to convey differential signal pairs. These differential signal pairs on surface-mount portions 152 may be isolated from each other by through-hole portions 142 of ground contacts. Through-hole portions 142 of the ground contacts may provide electrical isolation between differential pair signals conveyed using surface-mount portions 152. In this way, each differential pair conveyed on surface-mount portions 152 may have adjacent ground (or AC ground or other low-impedance path) contacts on each side and may be shielded by top shield 120 and bottom shield 130, as shown above. Through-hole portions 142, together with tabs 126 and 128, also form a shield or Faraday cage around the surface-mount portions 152, preventing electromagnetic interference from and to adjacent electronic components or devices.

Figure 8:
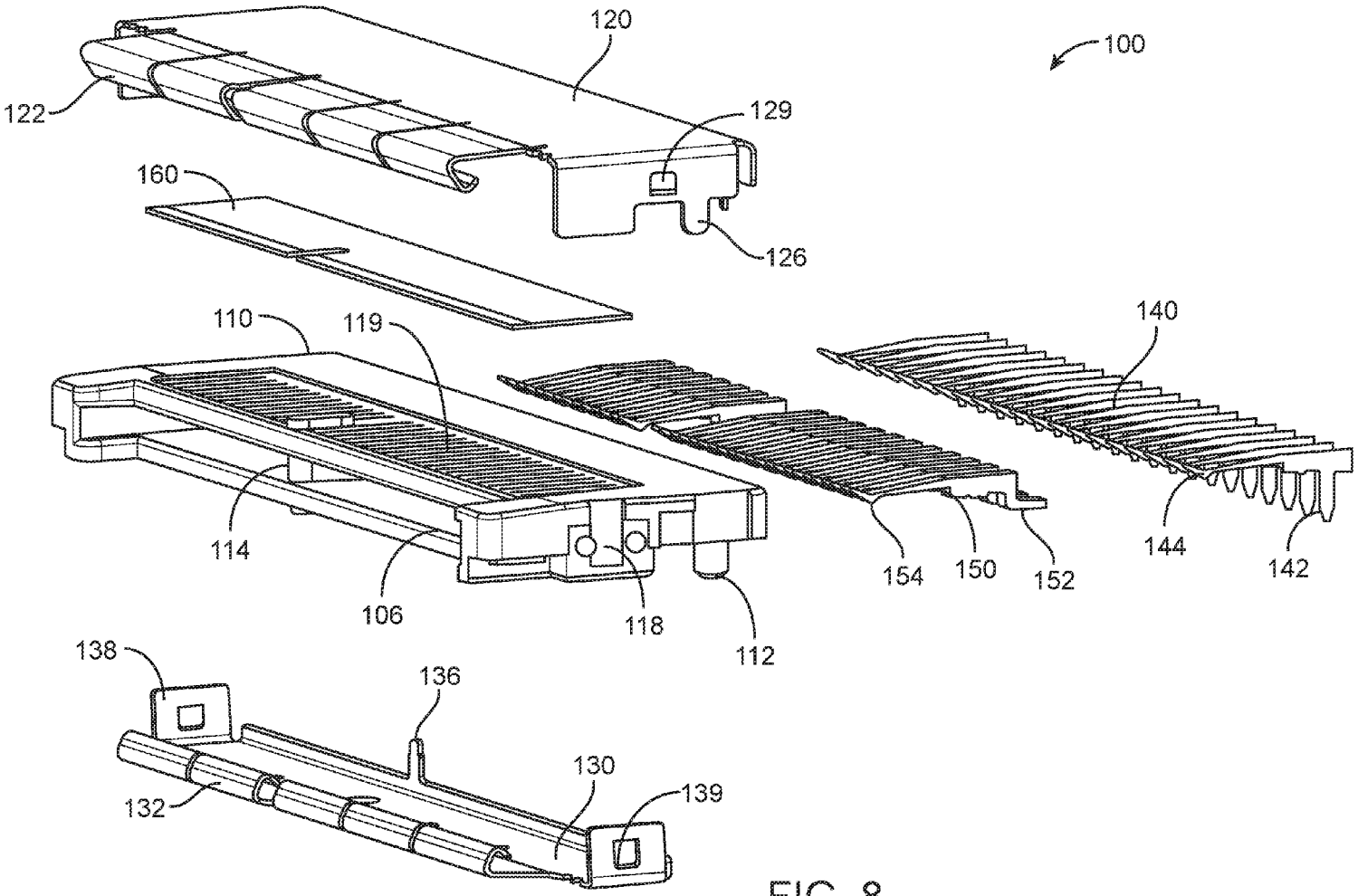
FIG. 8 is an exploded view of a connector according to an embodiment of the present invention.

FIG. 8 is an exploded view of a connector according to an embodiment of the present invention. Connector 100 may include housing 110. Housing 110 may include an opening 106 to accept card 200 (not shown). Housing 110 may include keying features 114. Keying features 114 may help to prevent a rotated insertion of card 200. Housing 110 may include posts 112, which may be inserted into openings in board 300 for mechanical support and alignment. Housing 110 may include slots 119 along the top side. Contacts 140 and 150 may be located in slots 119.

Connector 100 may include a top row of contacts 140 and 150. Contacts 140 may include a beam and contacting portion 144 and a through-hole portion 142. Similarly, contacts 150 may include a beam and contacting portion 154 and a surface-mount portion 152. Contacting portions 144 and 154 may form electrical connections with contacts on card 200. As described above, contacts 140 may be used to convey ground and to provide electromagnetic isolation for pairs of contacts 150. In practical applications, at least some of the contacts 140 may be used to convey power supplies, which may be considered to be AC grounds, as opposed to ground itself.

Connector 100 may include top shield 120. The front edge of top shield 120 may be folded back into opening 106 of housing 110 to form ground contacts 122. Top shield 120 may include tabs 126, which may be inserted into openings in board 300 (not shown).

Connector 100 may include bottom shield 130. Bottom shield 130 may include a front edge which may be folded back into opening 106 in housing 110 to form ground contacts 132. Bottom shield 130 may include tab 136 to meet with a tab (not shown) on top shield 120. Bottom shield 130 may further include side portions 138 including tabs 139. Tabs 139 may meet with tabs 129 on sides of top shield 120. Tabs 129 and 139 may be aligned with notches 118 in housing 110. Shield 120 may be soldered, or laser spot welded, to bottom shield 130. Bottom shield 130 may be grounded to top shield 120 via side portions 138 and tab 136. Top shield 120 may be grounded to board 130 via tabs 126 and 128, as shown above. Top shield 120 and bottom shield 130 may be grounded to card 200 through ground contacts 122 and 132.

Connector 100 may also include tape or other isolating feature 160. Tape or other isolating feature 160 may prevent contacts 140 and 150 from electrically contacting an inside surface of shield 120.

Figure 9:
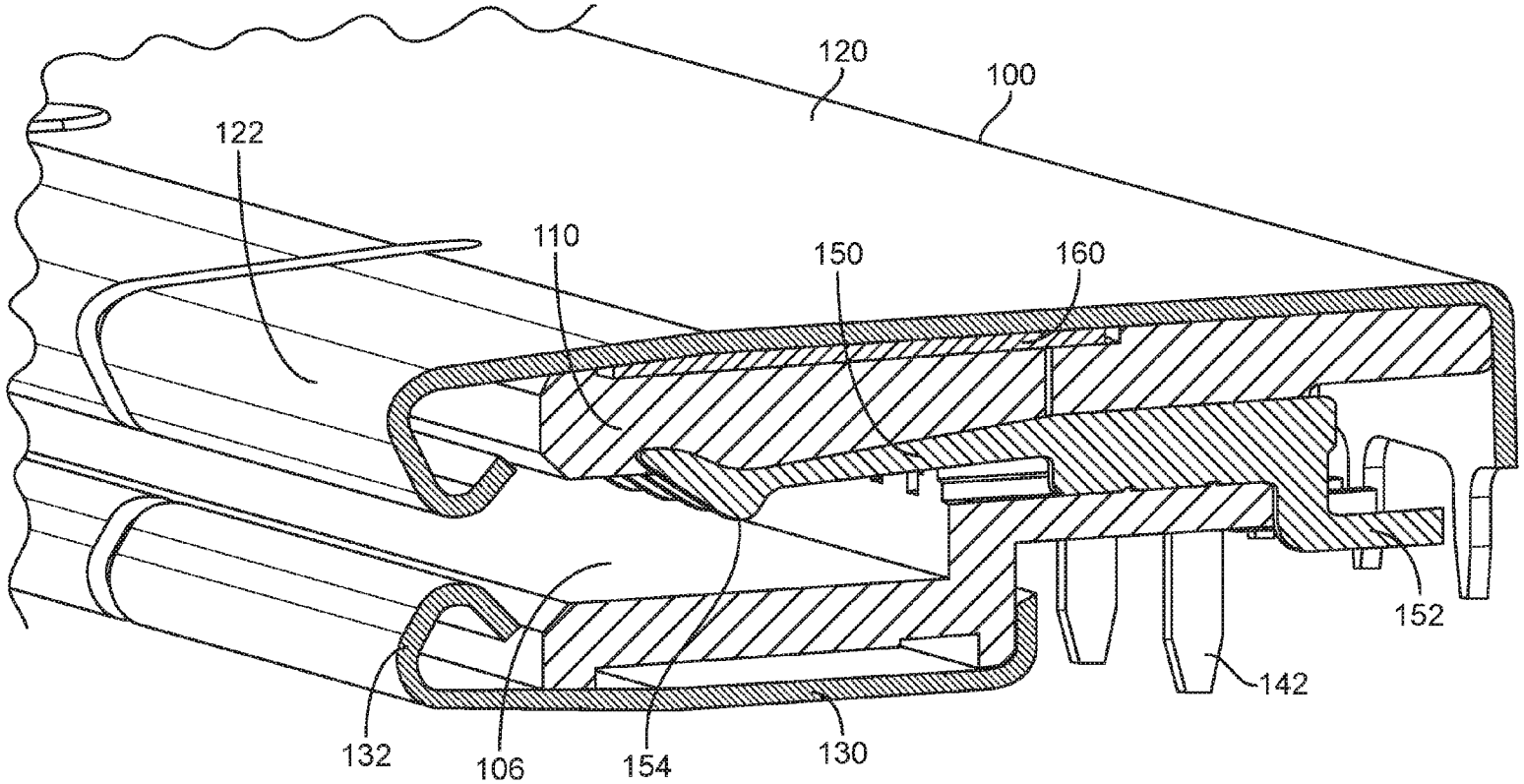
FIG. 9 illustrates a cut-away side view of a connector according to an embodiment of the present invention.

FIG. 9 illustrates a cut-away side view of a connector according to an embodiment of the present invention. Connector 100 may include top shield having ground contacts 122, and bottom shield 130 having ground contacts 132. Housing 110 may include an opening for receiving card 200 (not shown).

Connector 100 may include a top row of contacts 140 and 150. In this example, a side view of a contact 150 is shown. Contact 150 may include a beam contact portion 154 and a surface-mount portion 152. A through-hole portion 142 of a nearby contact is also shown. Isolating feature 160 may prevent contact 150 from electrically connecting to top shield 120.

In this example, opening 106 may have a greater vertical height than may be necessary for card 200. This additional vertical clearance may allow a user to remove card 200 by tilting card 200 in an upward direction and then pulling card 200 away from connector 100. In various embodiments of the present invention, this extra vertical clearance does not allow undesirable movement by card 200, since card 200 may be attached to board 300 at lateral extensions, as shown below and in FIG. 1.

Figure 10:
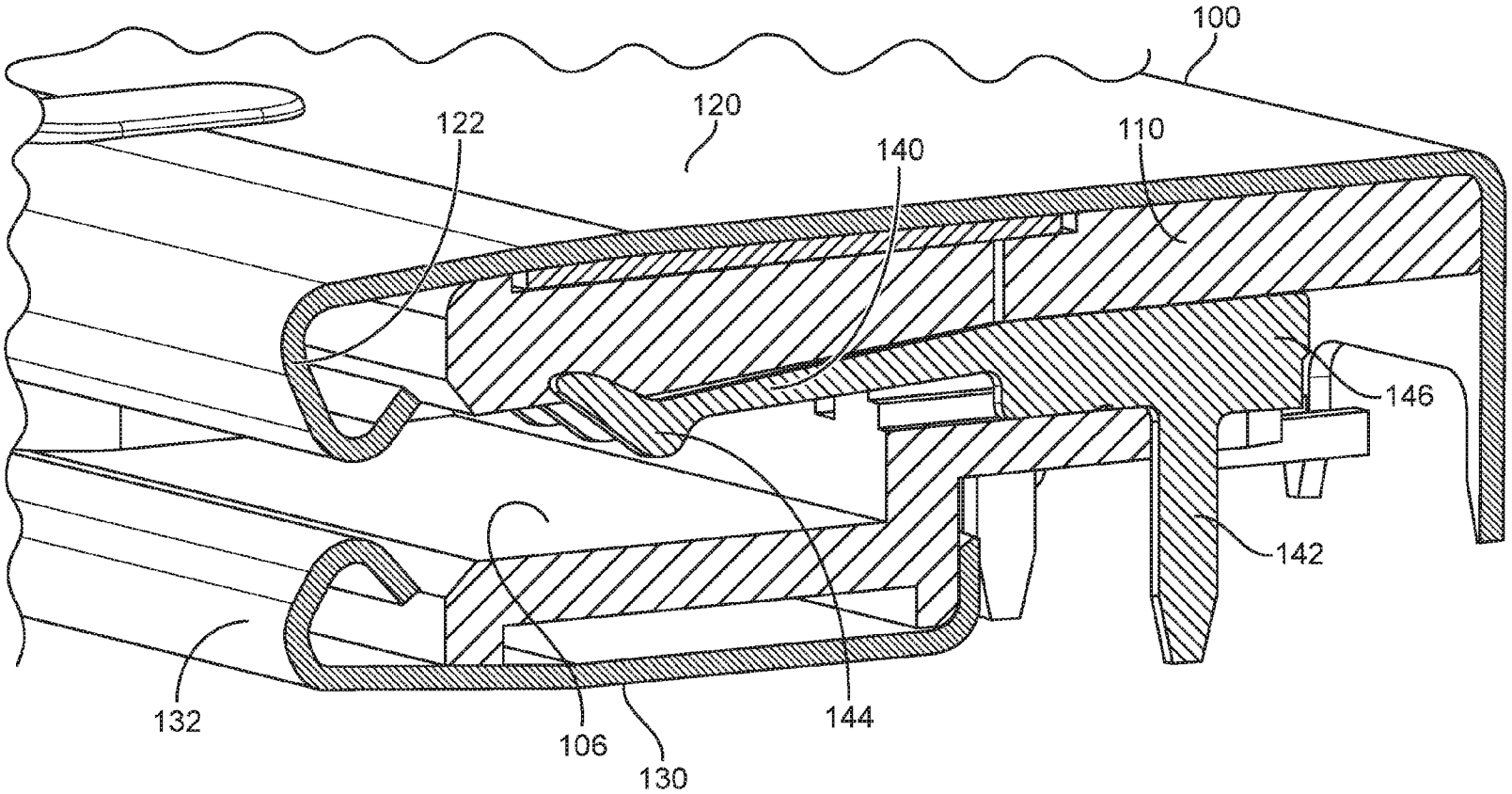
FIG. 10 illustrates a cut-away side view of a connector according to an embodiment of the present invention.

FIG. 10 illustrates a cut-away side view of a connector according to an embodiment of the present invention. As before, connector 100 may include a top shield having ground contacts 122 and a bottom shield 130 having ground contacts 132. Housing 110 may include an opening 106 for accepting card 200 (not shown). Connector 100 may include a top row of contacts including a contact 140 shown here. Contact 140 may include through-hole portion 142 and contacting portion 144. Contacts 140 may further include a tail portion 146 for additional stability and isolation.

Figure 11:
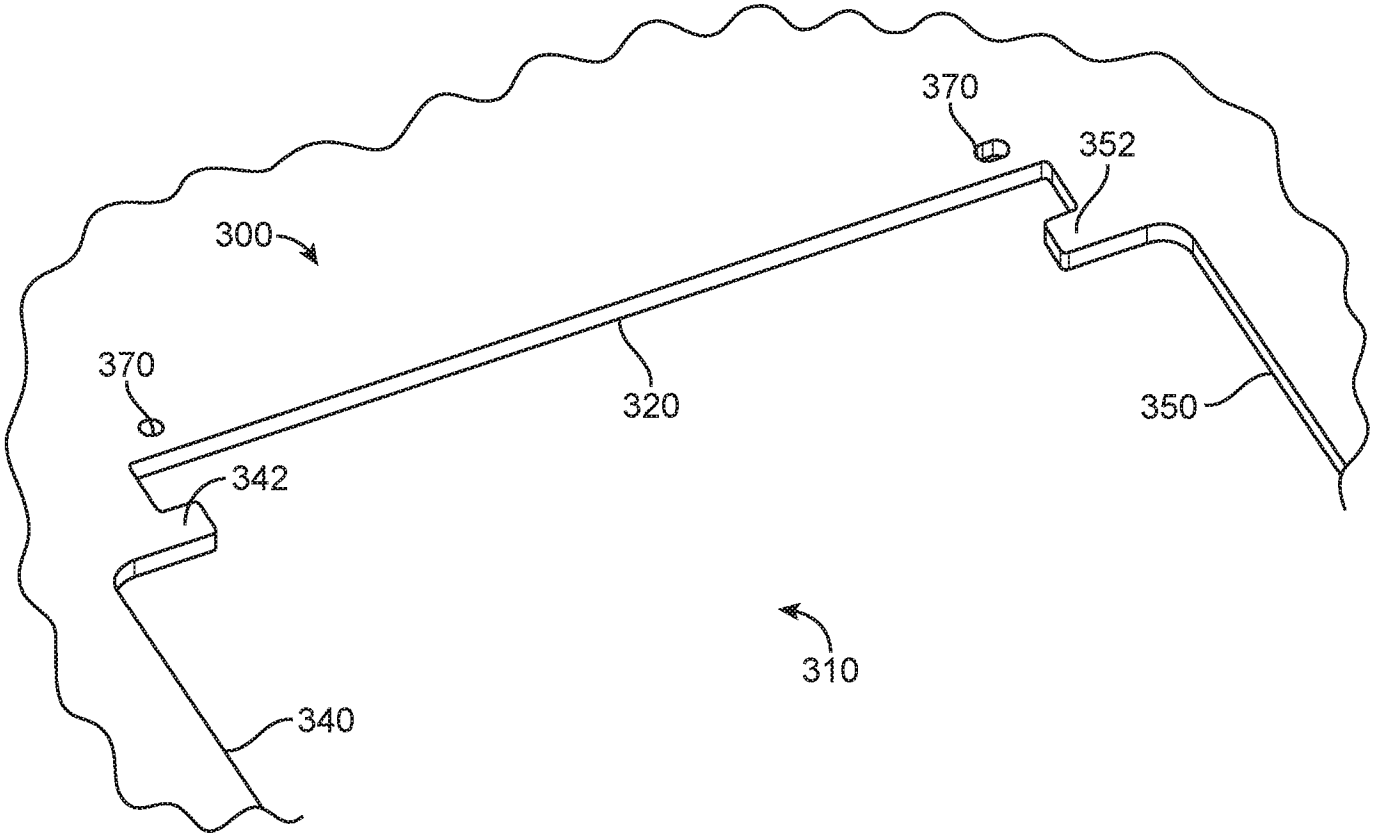
FIG. 11 illustrates a portion of a board according to an embodiment of the present invention.

FIG. 11 illustrates a portion of a board according to an embodiment of the present invention. Board 300 may be a printed circuit board, flexible circuit board, or other type of board or other appropriate substrate. Board 300 may include a first edge 320. A front portion 102 of a connector 100 (not shown) may be located beyond edge 320. Board 300 may further include facing or parallel edges 340 and 350. Edges 340 and 350 may include extensions 342 and 352. Extension 342 and 352 may be used to support narrow portions 118 of housing 110 as shown in FIG. 7. Board 300 may further include openings 370 and 372 for accepting posts 112 on connector 100. Opening 370 may be approximately a size to accept a post 112. Opening 372 may be slightly larger in a lateral direction to allow for minor variations in a size of housing 110 of connector 100.

Edges 320, 340, and 350 may define an end of board 300. Alternatively, edges 320, 340, and 350 may define sides of an opening 310 in board 300.

Figure 12:
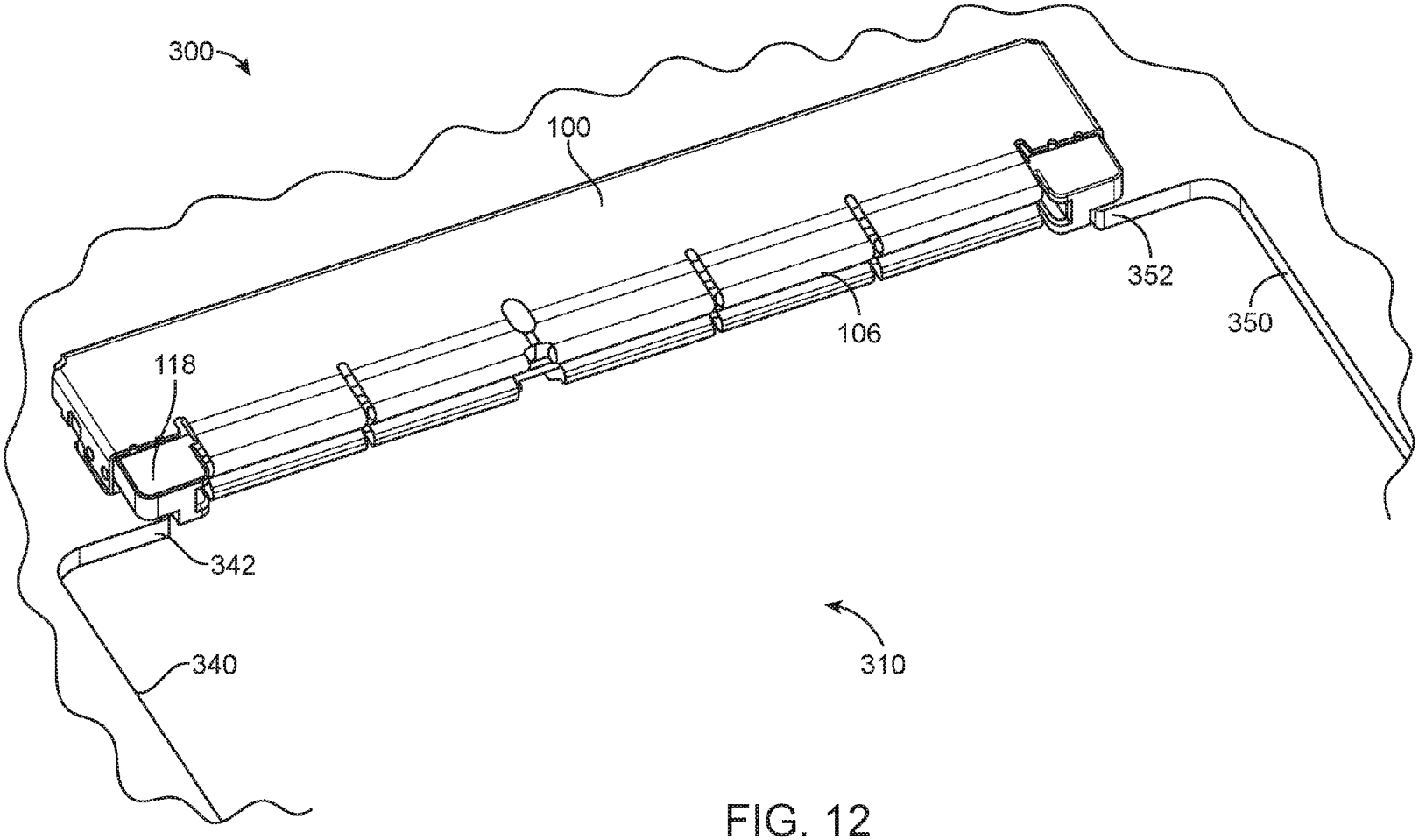
FIG. 12 illustrates a connector and a board according to an embodiment of the present invention.

FIG. 12 illustrates a connector and a board according to an embodiment of the present invention. In this example, connector 100 may be mounted on board 300. As described above, narrowed portion 118 may be placed on extensions 342 and 352 of edges 340 and 354 mechanical support. The card may be inserted into opening 106 of connector 100. An example of such a card is shown in the following figure.

Figure 13:
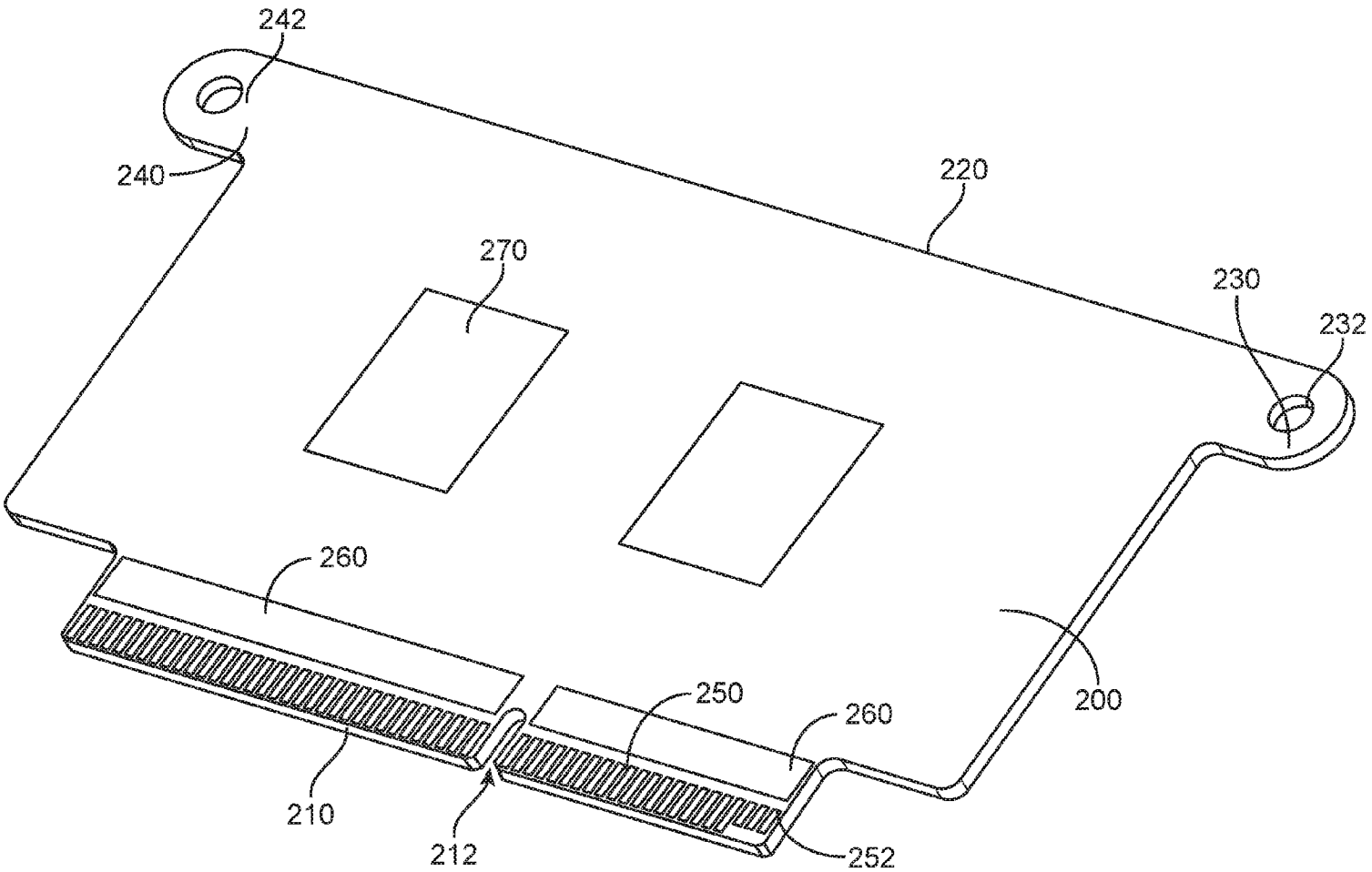
FIG. 13 illustrates a card according to an embodiment of the present invention.

FIG. 13 illustrates a card according to an embodiment of the present invention. Card 200 may be a solid-state drive (SSD), a subscriber interface module (SIM), or other type of card or module. Card 200 may include a first edge 210 and a second opposing edge 220. Contacts 250 may be located along first edge 210. First edge 210 may include notches 212 to mate with keying features 114 on connector 100 (not shown). Ground pads 260 may be located behind contacts 250 away from first edge 210. To ensure that ground contacts are formed before power is applied to card 200, power contacts 252 may have a leading edge pulled back away from first edge 210 of card 200.

Second edge 220 of card 200 may include lateral extensions 230 and 240. Lateral extensions 230 and 240 may include openings 232 and 242. Fasteners (not shown) may be placed in openings 232 and 242 and corresponding openings in board 300 (not shown) to secure card 200 in place. Card 200 may include one or more electronic devices, such as memories, interface chips, or other devices 270 on either of both top and bottom surfaces of card 200. Card 200 may include ground pads similar to ground pads 260 on a bottom side of card 200. In this example, connector 100 includes a top row of contacts. Accordingly, contacts 250 are located on the top side of card 200, as shown.

In various embodiments of the present invention, the components of the connectors may be formed in various ways of various materials. For example, contacts, shields, and other conductive portions of the connectors may be formed by stamping, metal-injection molding, machining, micro-machining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions, such as housing and other portions, may be formed using injection or other molding, 3-D printing, machining, or other manufacturing process. The nonconductive portions may be formed of silicon or silicone, rubber, hard rubber, plastic, nylon, elastomers, liquid-crystal polymers (LCPs), ceramics, or other nonconductive material or combination of materials.

Embodiments of the present invention may provide connectors, boards, and cards that may be located in various types of devices, such as portable computing devices, tablet computers, desktop computers, laptops, all-in-one computers, wearable computing devices, cell phones, smart phones, media phones, storage devices, portable media players, navigation systems, monitors, power supplies, adapters, remote control devices, chargers, and other devices. These connectors may provide pathways for signals and power for cards or other modules, such as solid state drives (SSDs), memory cards, subscriber identification modules (SIMs), Secure Digital cards, Secure Digital High Capacity cards, Secure Digital Extended Capacity cards, Secure Digital Ultra-High-Capacity I cards, Secure Digital Ultra-High-Capacity II cards, memory sticks, compact flash cards, communication modules, and other devices and modules that have been developed, are being developed, or will be developed in the future. These connectors may provide pathways for signals that are compliant with various standards such as Universal Serial Bus (USB), High-Definition Multimedia Interface® (HDMI), Digital Visual Interface (DVI), Ethernet, DisplayPort, Thunderbolt™, Lightning™, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. Embodiments of the present invention may provide these cards, supporting boards, and combinations of these cards, boards, and connectors.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

The invention claimed is:

1. An electronic device comprising:

a connector comprising:

a housing having a front opening;

a row of contacts located along the front opening in the housing;

a top shield over the housing and having a front edge folded over and into the front opening; and a bottom shield under the housing and having a front edge folded over and into the front opening, wherein the row of contacts comprises pairs of first contacts terminating in first connecting portions and single second contacts terminating in second connecting portions positioned between each pair of first contacts.

2. The electronic device of claim 1 wherein the first connecting portions are surface-mount portions and the second connecting portions are through-hole portions.

3. The electronic device of claim 2 further comprising a card inserted in the connector, the card comprising:

a ground pad; and a plurality of contacts on a top surface of the card and between a first edge of the card and the ground pad.

4. The electronic device of claim 3 wherein the card is one of a solid-state drive and a subscriber identification module.

5. The electronic device of claim 3 wherein the card further comprises a second edge opposite the first edge, the second edge having a first extended portion on a first end and a second extended portion on a second end, the first extended portion having a first opening and the second extended portion having a second opening.

6. The electronic device of claim 5 further comprising a board, wherein the connector is mounted partially over an opening on the board such that a bottom of the card is at least approximately in the same plane as a top of the board.

7. The electronic device of claim 6 further comprising a first fastener through the first opening in the card and a corresponding opening in the board and a second fastener through the second opening in the card and a corresponding opening in the board.

8. The electronic device of claim 7 wherein the bottom shield contacts the top shield via a first tab at a first end of the bottom shield, a second tab and a second end of the bottom shield, and a rear tab at a rear of the bottom shield.

9. The electronic device of claim 8 wherein the top shield includes a plurality of tabs along a rear, the tabs inserted into openings in the board.

10. The electronic device of claim 9 wherein the front opening of the housing comprises a keying feature.

11. The electronic device of claim 10 wherein the board is a printed circuit board.

12. The electronic device of claim 2 wherein the through-hole portions shield the surface-mount portions.

13. An electronic device comprising:

a board having first and second parallel edges and a third edge joining the first edge and second edge; and a connector having housing including a rear portion supporting a plurality of contacting portions for a row of contacts, the plurality of contacting portions connected to the board, the housing having a front portion extending away from the board and beyond the third edge, a top shield over the housing and having a front edge folded over and into a front opening, and a bottom shield under the housing and having a front edge folded over and into the front opening.

14. The electronic device of claim 13 wherein the row of contacts are located along a top of a front opening of the connector, wherein the row of contacts comprises pairs of first contacts terminating in surface-mount portions and single second contacts terminating in through-hole portions positioned between each pair of first contacts.

15. The electronic device of claim 13 further comprising a card having a first edge inserted in the connector, wherein the card comprises a second edge opposite the first edge, the second edge having a first extended portion on a first end and a second extended portion on a second end, the first extended portion having a first opening and the second extended portion having a second opening, the electronic device further comprising a first fastener through the first opening in the card and a corresponding opening in the board and a second fastener through the second opening in the card and a corresponding opening in the board.

16. An electronic device comprising:

a connector comprising:

a housing having a front opening; and a row of contacts located along the front opening in the housing, wherein the row of contacts comprises pairs of first contacts terminating in first connecting portions and single second contacts terminating in second connecting portions positioned between each pair of first contacts;

a card inserted in the connector, the card comprising:

a first ground pad on a top surface of the card; and a plurality of contacts on a top surface of the card and between a first edge of the card and the first ground pad, wherein the card further comprises a second edge opposite the first edge, the second edge having a first extended portion on a first end and a second extended portion on a second end, the first extended portion having a first opening and the second extended portion having a second opening; and a board having first and second facing edges and a third edge joining the first and second edge, wherein the connector has a rear portion supporting a plurality of contacting portions of the contacts, the plurality of contacting portions connected to the board and a front portion extending away from the board and beyond the third edge.

17. The electronic device of claim 16 wherein the first connecting portions are surface-mount portions, the second connecting portions are through-hole portions, and the through-hole portions shield the surface-mount portions.

* * * * *